US010046202B2

(12) United States Patent
Butler, Jr. et al.

(10) Patent No.: US 10,046,202 B2
(45) Date of Patent: Aug. 14, 2018

(54) INCLINE TRAINER SAFETY BRAKE

(71) Applicant: Digital Concepts of Missouri, Inc., Maryland Heights, MO (US)

(72) Inventors: James R. Butler, Jr., St. Peters, MO (US); Jack Greenwood, St. Peters, MO (US); Paul Decker, Creve Coeur, MO (US)

(73) Assignee: Digital Concepts of Missouri, Inc., Maryland Heights, MO (US)

( * ) Notice: Subject to any disclaimer, the term of this patent is extended or adjusted under 35 U.S.C. 154(b) by 0 days.

(21) Appl. No.: 15/186,965

(22) Filed: Jun. 20, 2016

(65) Prior Publication Data

US 2017/0001075 A1 Jan. 5, 2017

Related U.S. Application Data

(60) Provisional application No. 62/187,984, filed on Jul. 2, 2015.

(51) Int. Cl.

| | |
|---|---|
| ***A63B 24/00*** | (2006.01) |
| ***A63B 22/02*** | (2006.01) |
| ***A63B 21/00*** | (2006.01) |

(52) U.S. Cl.

CPC .... *A63B 24/0087* (2013.01); *A63B 21/00076* (2013.01); *A63B 22/0235* (2013.01)

(58) Field of Classification Search

CPC . A63B 24/00; A63B 24/0062; A63B 24/0087; A63B 21/00076; A63B 22/0235; A63B 22/02; A63B 22/0001

See application file for complete search history.

(56) References Cited

U.S. PATENT DOCUMENTS

| | | | | | |
|---|---|---|---|---|---|
| 3,869,121 | A * | 3/1975 | Flavell | A61B 5/22 | 482/2 |
| 4,842,266 | A * | 6/1989 | Sweeney, Sr. | A63B 22/02 | 482/54 |
| 5,100,127 | A * | 3/1992 | Melnick | A01K 15/027 | 119/700 |
| 5,312,310 | A * | 5/1994 | Shimizu | A63B 22/02 | 482/51 |
| 5,368,532 | A * | 11/1994 | Farnet | A63B 22/02 | 482/5 |

(Continued)

FOREIGN PATENT DOCUMENTS

| | | |
|---|---|---|
| EP | 1 630 422 A2 | 3/2006 |
| GB | 2 445 061 A | 6/2008 |
| WO | 2008/078121 A1 | 7/2008 |

*Primary Examiner* — Glenn Richman

(74) *Attorney, Agent, or Firm* — Senniger Powers LLP

(57) ABSTRACT

A motorized exercise apparatus for use with a power source comprising an exercise apparatus having a power supply configured to be connected to the power source. An electronically commutated motor is configured to drive the exercise apparatus. A controller is configured to connect a power supply to the motor to selectively energize the motor to drive the exercise apparatus and including an emergency stop feature. The controller selectively actuates the motor and disables activation of the motor when the emergency stop feature is actuated. An additional motor driven by the apparatus is configured to cause a dynamic braking action to slow the apparatus when the power source is disabled or when the emergency feature is actuated.

19 Claims, 1 Drawing Sheet

(56) References Cited

U.S. PATENT DOCUMENTS 5,499,956 A * 3/1996 Habing ..... A63B 21/023 482/51
5,944,635 A 8/1999 Butler, Jr.
6,004,244 A * 12/1999 Simonson ..... A63B 21/153 482/51
6,042,513 A * 3/2000 Koteles ..... A63B 24/00 318/1
6,875,157 B1 * 4/2005 Wang ..... A63B 22/0235 482/1
7,476,181 B1 * 1/2009 Honda ..... A63B 22/0235 482/51
7,686,589 B2 3/2010 Stiles, Jr. et al.
7,845,913 B2 12/2010 Stiles, Jr. et al.
7,854,597 B2 12/2010 Stiles, Jr. et al.
7,857,600 B2 12/2010 Koehl
7,874,808 B2 1/2011 Stiles
8,019,479 B2 9/2011 Stiles et al.
8,043,070 B2 10/2011 Stiles, Jr. et al.
8,104,110 B2 1/2012 Caudill et al.
8,465,262 B2 6/2013 Stiles, Jr. et al.
8,469,675 B2 6/2013 Stiles, Jr. et al.
8,480,373 B2 7/2013 Stiles, Jr. et al.
8,500,413 B2 8/2013 Stiles, Jr. et al.
8,540,493 B2 9/2013 Koehl
8,801,389 B2 8/2014 Stiles, Jr. et al.
8,840,376 B2 9/2014 Stiles, Jr. et al.
9,051,930 B2 6/2015 Stiles, Jr. et al.
9,238,918 B2 1/2016 McKinzie
9,328,727 B2 5/2016 Koehl
9,354,636 B2 5/2016 McKinzie
9,371,829 B2 6/2016 Koehl
9,404,500 B2 8/2016 Stiles, Jr. et al.
2005/0209056 A1 * 9/2005 Daly ..... A63B 22/001 482/52
2007/0298935 A1 12/2007 Badameh et al.
2009/0137367 A1 5/2009 Hendrickson et al.
2010/0093493 A1 * 4/2010 Eldridge ..... A63B 21/0058 482/4
2010/0222182 A1 * 9/2010 Park ..... A63B 21/0053 482/54
2011/0044823 A1 2/2011 Stiles
2011/0052416 A1 3/2011 Stiles
2011/0091329 A1 4/2011 Stiles, Jr. et al.
2014/0277776 A1 9/2014 McKinzie
2014/0314582 A1 10/2014 Stiles, Jr. et al.
2014/0322030 A1 10/2014 Stiles, Jr. et al.
2014/0363308 A1 12/2014 Stiles, Jr. et al.
2015/0030463 A1 1/2015 Stiles, Jr. et al.
2015/0204334 A1 7/2015 Stiles, Jr. et al.
2015/0211531 A1 7/2015 Stiles, Jr. et al.
2015/0300358 A1 10/2015 Stiles, Jr. et al.
2016/0131143 A1 5/2016 McKinzie
2016/0153456 A1 6/2016 Stiles, Jr. et al.
2016/0174531 A1 6/2016 Boothe et al.

* cited by examiner

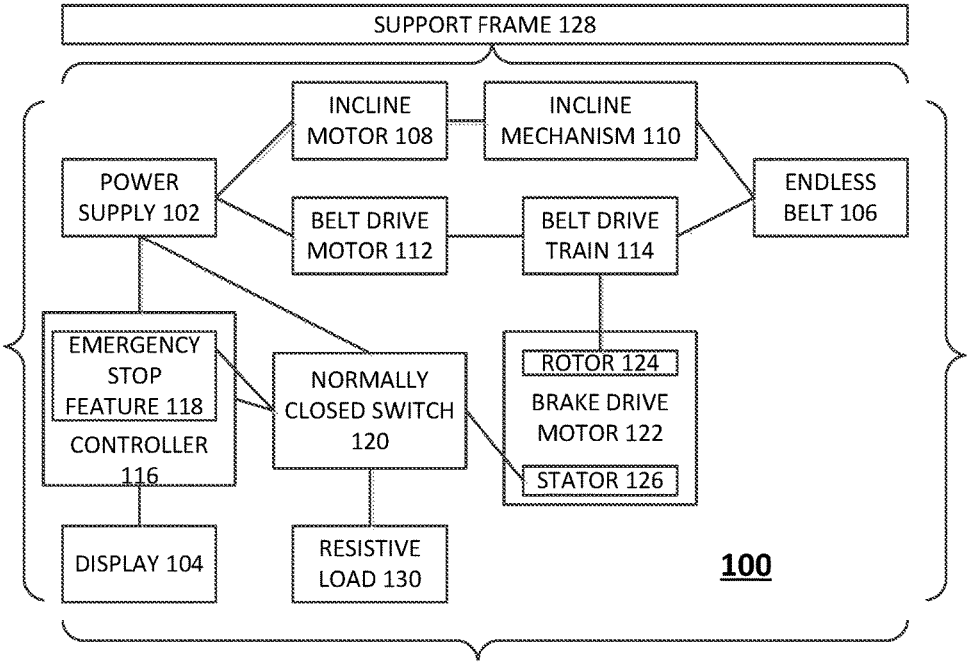
SUPPORT FRAME 128
INCLINE MOTOR 108
INCLINE MECHANISM 110
POWER SUPPLY 102
ENDLESS BELT 106
BELT DRIVE MOTOR 112
BELT DRIVE TRAIN 114
EMERGENCY STOP FEATURE 118
CONTROLLER 116
NORMALLY CLOSED SWITCH 120
ROTOR 124
BRAKE DRIVE MOTOR 122
STATOR 126
DISPLAY 104
RESISTIVE LOAD 130
100

INCLINE TRAINER SAFETY BRAKE

BACKGROUND OF THE INVENTION

The present invention generally relates to exercise devices and, in particular, treadmills and incline trainers.

U.S. Pat. No. 5,944,635, incorporated by reference herein in its entirety, is an example of treadmill having a safety shutdown and latch off. U.S. Pat. No. 5,944,635 is invented by the inventor of this application and has been assigned to Digital Concepts of Missouri, Inc., the assignee of this application.

The incline trainer is an example of one type of treadmill which allows for a very steep incline (e.g. 30% or more). Such products present at least two safety conditions related to emergency stops and/or loss of AC line power. When an emergency stop condition occurs, the power stage should to be disabled for safety. Several specifications require this. In addition, when the AC line voltage drops out for any reason, the power stage should also be disabled. If either condition occurs and the user is operating the treadmill at a high incline (e.g., above 15%), the belt can run away and rotate in reverse since the motor controller alone can no longer provide resistance or a braking action to slow the belt.

SUMMARY

A motorized exercise apparatus for use with a power source comprising an exercise apparatus having a power supply configured to be connected to the power source. An electronically commutated motor is configured to drive the exercise apparatus. A controller is configured to connect a power supply to the motor to selectively energize the motor to drive the exercise apparatus and including an emergency stop feature. The controller selectively actuates driving and braking of the motor and disables activation of the motor when the emergency stop feature is actuated. An additional motor driven by the apparatus is configured to cause a dynamic braking action to slow the apparatus when the power source is disabled or when the emergency feature is actuated.

Other objects and features will be in part apparent and in part pointed out hereinafter.

BRIEF DESCRIPTION OF THE DRAWINGS

FIG. 1 is a block diagram of one embodiment of a trainer/safety brake/apparatus according to the invention.

Corresponding reference characters indicate corresponding parts throughout the drawings.

DETAILED DESCRIPTION

One embodiment provides a low cost alternative to address these safety conditions and involves introducing a brush permanent magnet motor (DC motor) into a treadmill's drive train to provide dynamic braking. For example, a treadmill using a 2-quadrant (or greater) motor would be disabled under either an emergency stops and/or loss of AC line power. Frequently, a high incline treadmill includes at least a 2 quadrant motor controller. According to aspects of the invention, under normal operating conditions, the rotor of the introduced DC motor would freely spin within an open-circuited stator and provide no belt drive and minimal load (due to friction and bearing losses) to the treadmill and drive train. However, if either fault condition occurs and the main drive controller's power stage was disabled, a braking action would then be generated by the DC motor with a closed circuit across its stator terminals, such as a resistance/load across its terminals, which introduces a braking action into the drive train. In one form, the DC motor would introduce a load resistance allowing the endless belt to slow so the user could safely stop activity and exit the apparatus. During normal operation, the DC motor would have no resistive load placed across its terminals thus applying minimal load to the drive train.

In one form, the mechanism for switching in the resistance across the DC motor comprises a normally closed switch relay (with support circuitry) connected the power supply and/or the controller. The controller or other monitoring circuitry would command the relay open during normal operation and if the emergency stop event occurred or AC line power was lost, the relay would default to the normally closed position thus connecting a resistance across the DC motor's terminals. With the DC rotor spinning and with a short circuit such as a resistor across its stator terminals, a braking action would be present until the treadmill's speed dropped to a safe speed.

In one form, the brake drive motor provides a dynamic braking action. Dynamic braking is the use of an electric traction motor as a generator when slowing the endless belt. It can be rheostatic in which case the generated electrical power is dissipated as heat in brake grid resistors, or it can be regenerative in which case the generated power is stored or returned to a power source.

As illustrated in block diagram form in FIG. 1, one form of the trainer/safety brake/apparatus includes an incline trainer 100 for use with a power supply 102 configured to be connected to the power source such as 110 VAC. The trainer 100 includes a display 104 indicating status of the trainer and an endless belt 106 which rotates and accommodates a user using the trainer to exercise by walking, jogging, and/or running on the belt 106 as it moves in rotation. An incline motor 108 is configured to drive an incline mechanism 110 to incline the endless belt 106. The incline is controlled by the user via the display 104 to vary the intensity of the exercise. A rotor of a belt drive motor 112 connected to a belt drive train 114 is configured to drive the belt drive train 114 to rotate the endless belt 106. A controller 116 including an emergency stop feature 118 selectively de-actuates both the incline motor 108 and the belt drive motor 112 to disable activation of the belt drive motor 112 when the emergency stop feature 118 is actuated. For example, the emergency stop feature 118 can be a STOP button on the display 104 and/or a switch connected to a cord worn by the user. When the emergency stop feature 118 is actuated by a user, it causes the controller 116 to discontinue operation of the trainer 100.

A normally closed switch 120 (e.g., a relay) is connected to the power supply 102 and configured to be open when the power supply is energized and configured to be closed when the power supply is not energized. The normally closed switch 120 is connected to the emergency stop feature 118 via the controller 116. The switch 120 is configured to be open when the emergency stop feature 116 is not actuated and configured to be closed when the emergency stop feature 116 is actuated. A brake drive motor 122 having a stator 126 connected to the normally closed switch 120 and having a rotor 124 connected to the belt drive train 114 and/or the endless belt 106. The rotor 124 is configured to rotate when the belt is rotating. In one form, the rotor of the belt drive motor 112 drives the belt drive train 114 which drives (e.g., rotates) the endless belt 106. On the other hand, the rotor 124 is driven by endless belt 106 which drives the belt drive train 114 when the belt drive motor 112 is not energized.

The stator 126 is open-circuited by the normally closed switch 120 when the power supply 102 is energized (thereby energizing the switch 120) and the emergency stop feature 116 is not actuated. The stator 126 is closed-circuited by the normally closed switch 120 when the power supply is not energized (thereby not energizing the switch 120) or when the emergency feature is actuated thereby braking the endless belt 106 caused by the belt drive train 114 being decelerated by the brake drive motor 122.

In one form, the trainer 100 comprises a treadmill having a support frame 128 which supports the above-noted elements of the trainer 100 in an integrated, unitary apparatus. In other forms, the trainer 100 comprises a motorized exercise apparatus.

The normally closed switch 120 connects the stator 126 to a resistive load 130 (e.g., a resistor) when the switch 120 is closed (not energized) so that the stator is short-circuited by the resistive load 130. Potential and kinetic energy due to movement of the belt 106 and/or due to gravity acting on a user on an inclined belt is dissipated as heat in the resistive load 130.

In one form, a safety brake for an incline trainer has the power supply 102, display 104, endless belt 106, incline motor 108 driving the incline mechanism 110, belt drive motor 112 driving the belt drive train 114 to rotate the endless belt 106, and controller 116, as noted herein. In this form, the safety brake comprises the normally closed switch 120 and brake drive motor 122, as noted herein.

In operation, a user on the trainer 100 would use display 104 to provide user input to the controller 116 to rotate the endless 106 and to incline the endless belt 106. The controller 116, in response to user input, would activate the belt drive motor 112 to drive the belt drive train 114 to rotate the endless belt. In addition, the controller 116, in response to user input, would activate the incline motor 108 to drive the incline mechanism 110 to raise one end of the endless belt thereby inclining the belt. As long as the power supply 102 is energized, the controller 116 provides power to the normally closed switch 120 causing its contacts to open circuit. In the event that the user activates the emergency stop feature 118, the controller 116 responds by discontinuing power to the belt drive motor 112, to the incline motor 108, and to the normally closed switch 120 causing its contacts to close circuit. As a result, the resistive load 130 is connected to the stator 126 of the brake drive motor 122 causing the rotor 124 to resist rotation and slow the belt drive train 114 which slows the endless belt 106 and inhibits forward or reverse rotation of the belt. In the event of power loss, the controller 116 is deactivated so that no power is provided to the belt drive motor 112, to the incline motor 108, and to the normally closed switch 120 causing its contacts to close circuit. As a result, the resistive load 130 is connected to the stator 126 of the brake drive motor 122 causing the rotor 124 to resist rotation and slow the belt drive train 114 which slows the endless belt 106 and inhibits forward or reverse rotation of the belt.

In one form, a motorized exercise apparatus for use with a power source comprises an exercise apparatus such as trainer 100 having the power supply 102 configured to be connected to a power source. The apparatus includes an electronically commutated motor (e.g., motor 112) configured to have a rotor to drive the exercise apparatus and a controller (e.g., controller 116) configured to connect the power supply to the electronically commutated motor to selectively energize the electronically commutated motor to drive the exercise apparatus. The apparatus includes an emergency stop feature (e.g., feature 118) and its controller selectively actuates the electronically commutated motor. The controller disables activation of the electronically commutated motor when the emergency stop feature is actuated. An additional motor (e.g., motor 122) is driven by the apparatus and is configured to cause a dynamic braking action to slow the apparatus when the power source is disabled or when the emergency feature is actuated.

In one form, the trainer 100, and/or safety brake, and/or apparatus is configured such that the stator 126 has a coil having first and second terminals. The switch 120 has normally closed contacts connected to the first and second terminals. As a result, when the contacts are closed the stator 126 is short-circuited (causing dynamic braking), and when the contacts are open the stator 126 is an open circuit.

In one form, the trainer 100, and/or safety brake, and/or apparatus is configured such that the stator 126 of the brake drive motor 122 is only connected to the normally closed switch 120 and is not externally energized in any mode.

In one form, the trainer 100, and/or safety brake, and/or apparatus is configured such that the brake drive motor 122 is a brush, permanent magnet, DC motor configured to cause a dynamic braking action to slow the endless belt 106. Alternatively, the brake drive motor 122 can be a permanent magnet motor, a brushless motor, a generator, or any other electro-motive device which when rotated causes a braking action.

Alternatively or in addition, the load applied to the brake drive motor 122 include short circuiting, resistive, rheostatic, regenerative, an active load powered by the brake drive motor 122, and/or a combination of these loads. For example, in some embodiments when the brake drive motor 122 is active and generating a voltage, if the speed is high the voltage could be high and a static resistor could create too high of a load and braking action. In this embodiment, it is contemplated that a circuit can be place across the stator terminals of brake drive motor 122 that would utilize the voltage generated, and regulate it down for use by control circuitry that would allow the resistive load to be actively switched in and out to linearly apply the load in a controlled manner (e.g., minimally or lightly at high speeds and increasing as the speed/voltage drops).

In one form, the trainer 100, and/or safety brake, and/or apparatus is configured such that the incline mechanism 110 is configured to incline the endless belt 106 at a maximum incline in a range of at least 15% or more relative to horizontal.

In one form, the trainer 100, and/or safety brake, and/or apparatus is configured such that the incline mechanism 110 is configured to incline the endless belt 106 at a maximum incline in a range of about 15% to 35% or more relative to horizontal.

In one form, the incline mechanism is not driven by a motor and is manually operated by a user so that the trainer does not have an incline motor.

As noted herein, the belt drive motor 112 operates in 2 quadrants—driving and braking when AC line power is active and the emergency stop feature 118 is not actuated. The brake drive motor 122 operates in a dynamic braking mode only. Thus, in one form there are 2 different motors which can operate as a brake but one (motor 112) is associated with active AC line power and/or no emergency stop and the other (motor 122) is without AC line power and/or an Emergency Stop event.

It is also contemplated that the brake drive rotor 124 may be mechanically linked to the rotor of the belt drive motor

112 as a way of being linked to the belt drive train 114 since the rotor of the belt drive motor 112 can be considered part of the drive train 114.

The Abstract and summary are provided to help the reader quickly ascertain the nature of the technical disclosure. They are submitted with the understanding that they will not be used to interpret or limit the scope or meaning of the claims. The summary is provided to introduce a selection of concepts in simplified form that are further described in the Detailed Description. The summary is not intended to identify key features or essential features of the claimed subject matter, nor is it intended to be used as an aid in determining the claimed subject matter.

For purposes of illustration, programs and other executable program components, such as the operating system, are illustrated herein as discrete blocks. It is recognized, however, that such programs and components reside at various times in different storage components of a computing device, and are executed by a data processor(s) of the device.

Although described in connection with an exemplary computing system environment, embodiments of the aspects of the invention are operational with numerous other special purpose computing system environments or configurations. The computing system environment is not intended to suggest any limitation as to the scope of use or functionality of any aspect of the invention. Moreover, the computing system environment should not be interpreted as having any dependency or requirement relating to any one or combination of components illustrated in the exemplary operating environment. Examples of well-known computing systems, environments, and/or configurations that may be suitable for use with aspects of the invention include, but are not limited to, personal computers, server computers, hand-held or laptop devices, multiprocessor systems, microprocessor-based systems, set top boxes, programmable consumer electronics, mobile telephones, network PCs, minicomputers, mainframe computers, distributed computing environments that include any of the above systems or devices, and the like.

Embodiments of the aspects of the invention may be described in the general context of data and/or processor-executable instructions, such as program modules, stored one or more tangible, non-transitory storage media and executed by one or more processors or other devices. Generally, program modules include, but are not limited to, routines, programs, components, and data structures that perform particular tasks or implement particular abstract data types. Aspects of the invention may also be practiced in distributed computing environments where tasks are performed by remote processing devices that are linked through a communications network. In a distributed computing environment, program modules may be located in both local and remote storage media including memory storage devices.

In operation, processors, computers and/or servers may execute the processor-executable instructions (e.g., software, firmware, and/or hardware) such as those illustrated herein to implement aspects of the invention.

Embodiments of the aspects of the invention may be implemented with processor-executable instructions. The processor-executable instructions may be organized into one or more processor-executable components or modules on a tangible processor readable storage medium which is not a signal. Aspects of the invention may be implemented with any number and organization of such components or modules. For example, aspects of the invention are not limited to the specific processor-executable instructions or the specific components or modules illustrated in the FIGURE and described herein. Other embodiments of the aspects of the invention may include different processor-executable instructions or components having more or less functionality than illustrated and described herein.

The order of execution or performance of the operations in embodiments of the aspects of the invention illustrated and described herein is not essential, unless otherwise specified. That is, the operations may be performed in any order, unless otherwise specified, and embodiments of the aspects of the invention may include additional or fewer operations than those disclosed herein. For example, it is contemplated that executing or performing a particular operation before, contemporaneously with, or after another operation is within the scope of aspects of the invention.

All references, including without limitation all papers, publications, presentations, texts, reports, manuscripts, brochures, internet postings, journal articles, periodicals, and the like, cited in this specification are hereby incorporated by reference. The discussion of the references herein is intended merely to summarize the assertions made by their authors and no admission is made that any reference constitutes prior art. The inventors reserve the right to challenge the accuracy and pertinence of the cited references.

It is intended that all patentable subject matter disclosed herein be claimed and that no such patentable subject matter be dedicated to the public. Thus, it is intended that the claims be read broadly in light of that intent. In addition, unless it is otherwise clear to the contrary from the context, it is intended that all references to "a" and "an" and subsequent corresponding references to "the" referring back to the antecedent basis denoted by "a" or "an" are to be read broadly in the sense of "at least one." Similarly, unless it is otherwise clear to the contrary from the context, the word "or," when used with respect to alternative named elements is intended to be read broadly to mean, in the alternative, any one of the named elements, any subset of the named elements or all of the named elements.

In view of the above, it will be seen that several advantages of the aspects of the invention are achieved and other advantageous results may be attained.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively or in addition, a component may be implemented by several components.

The above description illustrates the aspects of the invention by way of example and not by way of limitation. This description enables one skilled in the art to make and use the aspects of the invention, and describes several embodiments, adaptations, variations, alternatives and uses of the aspects of the invention, including what is presently believed to be the best mode of carrying out the aspects of the invention. Additionally, it is to be understood that the aspects of the invention is not limited in its application to the details of construction and the arrangement of components set forth in the following description or illustrated in the drawings. The aspects of the invention are capable of other embodiments and of being practiced or carried out in various ways. Also, it will be understood that the phraseology and terminology used herein is for the purpose of description and should not be regarded as limiting.

Having described aspects of the invention in detail, it will be apparent that modifications and variations are possible without departing from the scope of the invention as defined in the appended claims. It is contemplated that various changes could be made in the above constructions, products, and methods without departing from the scope of aspects of the invention. In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

What is claimed is:

1. An incline trainer for use with a power source comprising:

a power supply configured to be connected to the power source;

a display;

an endless belt an incline mechanism to incline the endless belt;

a belt drive motor connected to a belt drive train and configured to drive the belt drive train to rotate the endless belt;

a controller including an emergency stop feature, said controller for selectively actuating the incline motor and the belt drive motor and for disabling activation of the belt drive motor when the emergency stop feature is actuated;

a normally closed switch selectively connected to the power supply and configured to be open when the power supply is energized and configured to be closed when the power supply is not energized, said normally closed switch connected to the emergency stop feature and configured to be open when the emergency stop feature is not actuated and configured to be closed when the emergency stop feature is actuated;

a brake drive motor having a stator connected to the normally closed switch and having a rotor connected to the belt drive train and/or the endless belt, the rotor configured to rotate when the belt is rotating;

wherein the stator is open-circuited by the normally closed switch when the power supply is energized and the emergency stop feature is not actuated; and wherein the stator is closed-circuited by the normally closed switch when the power supply is not energized or when the emergency feature is actuated thereby braking the endless belt.

2. The trainer of claim 1 wherein the stator of the brake drive motor is only connected to the normally closed switch and is not externally energized in any mode.

3. The trainer of claim 1 wherein the brake drive motor is a brush, permanent magnet, DC motor configured to cause a dynamic braking action to slow the endless belt.

4. The trainer of claim 1 wherein the normally closed switch connects the stator to a resistive load when the switch is closed so that the stator is short-circuited by the resistive load.

5. The trainer of claim 1 wherein the incline mechanism is configured to incline the endless belt at a maximum incline in a range of at least 15% or more.

6. The trainer of claim 1 wherein the incline mechanism is configured to incline the endless belt at a maximum incline in a range of about 15% to 30%.

7. The trainer of claim 1 wherein the stator has a coil having first and second terminals, wherein the switch has normally closed contacts connected to the first and second terminals, wherein when the contacts are closed the stator is short-circuited, and wherein when the contacts are open the stator is an open circuit.

8. A safety brake for an incline trainer having:

a power supply configured to be connected to the power source;

a display;

an endless belt;

an incline motor configured to drive an incline mechanism to incline the endless belt;

a belt drive motor connected to a belt drive train and configured to drive the belt drive train to rotate the endless belt;

a controller including an emergency stop feature, said controller for selectively de-actuating both the incline motor and the belt drive motor and for disabling activation of the belt drive motor when the emergency stop feature is actuated;

said safety brake comprising:

a normally closed switch selectively connected to the power supply and configured to be open when the power supply is energized and configured to be closed when the power supply is not energized, said normally closed switch connected to the emergency stop feature and configured to be open when the emergency stop feature is not actuated and configured to be closed when the emergency stop feature is actuated;

a brake drive motor having a stator connected to the normally closed switch and having a rotor connected to the belt drive train and/or the endless belt, the rotor configured to rotate when the belt is rotating;

wherein the stator is open-circuited by the normally closed switch when the power supply is energized and the emergency stop feature is not actuated; and wherein the stator is closed-circuited by the normally closed switch when the power supply is not energized or when the emergency feature is actuated thereby braking the endless belt.

9. The brake of claim 8 wherein the stator of the brake drive motor is only connected to the normally closed switch and is not externally energized in any mode.

10. The brake of claim 8 wherein the brake drive motor is a brush, permanent magnet, DC motor configured to cause a dynamic braking action to slow the endless belt.

11. The brake of claim 8 wherein the normally closed switch connects the stator to a resistive load when the switch is closed so that the stator is short-circuited by the resistive load.

12. The brake of claim 8 wherein the incline mechanism is configured to incline the endless belt at a maximum incline in a range of at least 15% or more.

13. The brake of claim 8 wherein the incline mechanism is configured to incline the endless belt at a maximum incline in a range of about 15% to 30%.

14. The brake of claim 8 wherein the stator has a coil having first and second terminals, wherein the switch has normally closed contacts connected to the first and second terminals, wherein when the contacts are closed the stator is short-circuited, and wherein when the contacts are open the stator is an open circuit.

15. A motorized exercise apparatus for use with a power source, comprising:

an exercise apparatus having a power supply configured to be connected to the power source;

an electronically commutated motor configured to drive the exercise apparatus;

a controller configured to connect the power supply to the motor to selectively energize the motor to drive the exercise apparatus and including an emergency stop feature, said controller for selectively actuating the motor and for disabling activation of the motor when the emergency stop feature is actuated;

an additional motor driven by the apparatus and configured to cause a dynamic braking action to slow the apparatus when the power source is disabled or when the emergency feature is actuated; and a normally closed switch, wherein a stator of the additional motor is only connected to the normally closed switch and is not externally energized in any mode, wherein the stator has a coil having first and second terminals, wherein the switch has normally closed contacts connected to the first and second terminals, wherein when the contacts are closed the stator is short-circuited, and wherein when the contacts are open the stator is an open circuit.

16. The apparatus of claim 15 wherein the normally closed switch connects the stator to a resistive load when the switch is closed so that the stator is short-circuited by the resistive load.

17. A motorized exercise apparatus for use with a power source, comprising:

an exercise apparatus having a power supply configured to be connected to the power source;

an electronically commutated motor configured to drive the exercise apparatus;

a controller configured to connect the power supply to the motor to selectively energize the motor to drive the exercise apparatus and including an emergency stop feature, said controller for selectively actuating the motor and for disabling activation of the motor when the emergency stop feature is actuated;

an additional motor driven by the apparatus and configured to cause a dynamic braking action to slow the apparatus when the power source is disabled or when the emergency feature is actuated; and an endless belt driven by the electronically commutated motor, wherein the additional motor is a brush, permanent magnet, DC motor configured to cause the dynamic braking action to slow the endless belt.

18. The apparatus of claim 17, further comprising an incline mechanism, wherein the incline mechanism is configured to incline the endless belt at a maximum incline in a range of at least 15% or more.

19. The apparatus of claim 18 wherein the incline mechanism is configured to incline the endless belt at a maximum incline in a range of about 15% to 30%.

* * * * *